US012049799B2

(12) United States Patent
Batho et al.

(10) Patent No.: US 12,049,799 B2
(45) Date of Patent: Jul. 30, 2024

(54) NOISE MITIGATION OF SUBSEA OIL AND GAS EQUIPMENT USING SUBSEA ACOUSTIC INSULATION

(71) Applicant: Chevron U.S.A. Inc., San Ramon, CA (US)

(72) Inventors: Peter F. Batho, Houston, TX (US); Grant A. Fraser, Aberdeen (GB)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 18/063,966

(22) Filed: Dec. 9, 2022

(65) Prior Publication Data

US 2023/0184047 A1 Jun. 15, 2023

Related U.S. Application Data

(60) Provisional application No. 63/287,632, filed on Dec. 9, 2021.

(51) Int. Cl.
*E21B 33/037* (2006.01)
*E21B 43/017* (2006.01)

(52) U.S. Cl.
CPC ..... *E21B 33/037* (2013.01); *E21B 43/017* (2013.01)

(58) Field of Classification Search
CPC .... E21B 33/037; E21B 43/017; F04B 53/002; G10K 1/36
See application file for complete search history.

(56) References Cited

U.S. PATENT DOCUMENTS

| | | | | |
|---|---|---|---|---|
| 9,812,112 | B2 * | 11/2017 | Wochner | G10K 11/172 |
| 10,138,714 | B2 * | 11/2018 | Ward | E21B 41/0007 |
| 10,794,032 | B2 * | 10/2020 | Jung | E02D 7/02 |
| 2006/0210859 | A1 * | 9/2006 | Choi | F04D 29/669 429/513 |
| 2015/0110564 | A1 * | 4/2015 | West | E02D 13/005 405/227 |
| 2017/0328162 | A1 | 11/2017 | Ellingsen | |

FOREIGN PATENT DOCUMENTS

| | | | |
|---|---|---|---|
| CN | 207500145 | U | 6/2018 |
| CN | 207830756 | U | 9/2018 |
| WO | 2011036575 | A2 | 3/2011 |

OTHER PUBLICATIONS

Binnerts B et al, "SPE-179398-MS Underwater Sound Radiation From Subsea Factories", Apr. 11, 2016, p. 11-13, Retrieved from the Internet: URL: https://onepetro.org/SPEHSE/proceedings-pdf/16HSE/2-16HSE/1396115/spe-179398-ms.pdf; XP093031059.

(Continued)

*Primary Examiner* — Aaron L Lembo
(74) *Attorney, Agent, or Firm* — Avery L. Cate

(57) ABSTRACT

Subsea acoustic insulation is used to mitigate noise associated with any one or a combination of a deep-water production tree, a deep-water manifold or structure, subsea pumping equipment, or subsea compression equipment. A subsea oil and gas facility includes subsea equipment having one or more devices that generate noise during operation, and subsea acoustic insulation surrounds at least a portion of the subsea equipment and is configured to attenuate the generated noise.

20 Claims, 4 Drawing Sheets

(56) References Cited

OTHER PUBLICATIONS

John M. Ward "Understanding and Mitigation of Underwater Sound in the Arctic," Paper presented at the OTC Arctic Technology Conference, Houston, Texas, USA, Feb. 2011; doi: https://doi.org/10.4043/22128-MS.
PCT International Search Report mailed on Mar. 22, 2023, issued in International Application No. PCT/US2022/081259, filed on Dec. 9, 2022, 06 pages.

* cited by examiner

NOISE MITIGATION OF SUBSEA OIL AND GAS EQUIPMENT USING SUBSEA ACOUSTIC INSULATION

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Subsea noise its sources and impacts are being increasingly scrutinized by non-governmental organizations and regulators. Anthropogenic noise emissions from shipping, defense and other operations and their consequences on a wide range of wildlife activities are being increasingly documented and understood. The development of subsea oil and gas facilities and resultant deployment of underwater production trees, flow control valves, machinery and processing equipment on the seabed may generate long term noise that is transmissible over long distances. Accordingly, it is now recognized that a need exists for such long term noise to be mitigated.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with various aspects of this disclosure, subsea acoustic insulation is used to mitigate noise associated with subsea equipment, such as any one or a combination of a deep-water production tree, a deep-water manifold or structure, subsea pumping equipment, or subsea compression equipment.

In accordance with an embodiment of this disclosure, a subsea oil and/or gas system includes subsea equipment configured to produce, process, and transmit fluids from a subsea well to topsides equipment configured to receive processed produced fluids from the subsea equipment. The system also includes subsea acoustic insulation surrounding a portion of the subsea equipment that generates noise during operation, the subsea acoustic insulation being configured to attenuate noise emitted by the portion of the subsea equipment.

In accordance with another embodiment of this disclosure, a subsea compression module configured for use in a subsea environment includes a subsea compressor configured to compress a fluid produced from a subsea oil and/or gas well and having subsea acoustic insulation configured to attenuate noise generated by the subsea compressor during operation. The subsea acoustic insulation surrounds at least a portion of an exterior of the subsea compressor.

In accordance with another embodiment of this disclosure, a subsea pumping module configured for use in a subsea environment includes a subsea pump configured to pressurize a fluid produced from a subsea oil and/or gas well and having subsea acoustic insulation configured to attenuate noise generated by the subsea pump during operation, and wherein the subsea acoustic insulation surrounds at least a portion of an exterior of the subsea pump.

In accordance with another embodiment of this disclosure, a deepwater production tree configured for use in a subsea environment includes a flow control valve configured to modulate fluid produced from a subsea oil and/or gas well and having subsea acoustic insulation configured to attenuate noise generated by the flow control valve during production. The subsea acoustic insulation surrounds at least a portion of an exterior of the flow control valve.

In accordance with a further embodiment of this disclosure, a method of mitigating noise associated with a subsea oil and/or gas facility includes using subsea acoustic insulation to mitigate noise associated with any one or a combination of a deep-water production tree, flow control valves and piping, a deep-water manifold or structure, subsea pumping equipment, or subsea compression equipment.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF THE INVENTION

Figure 1:
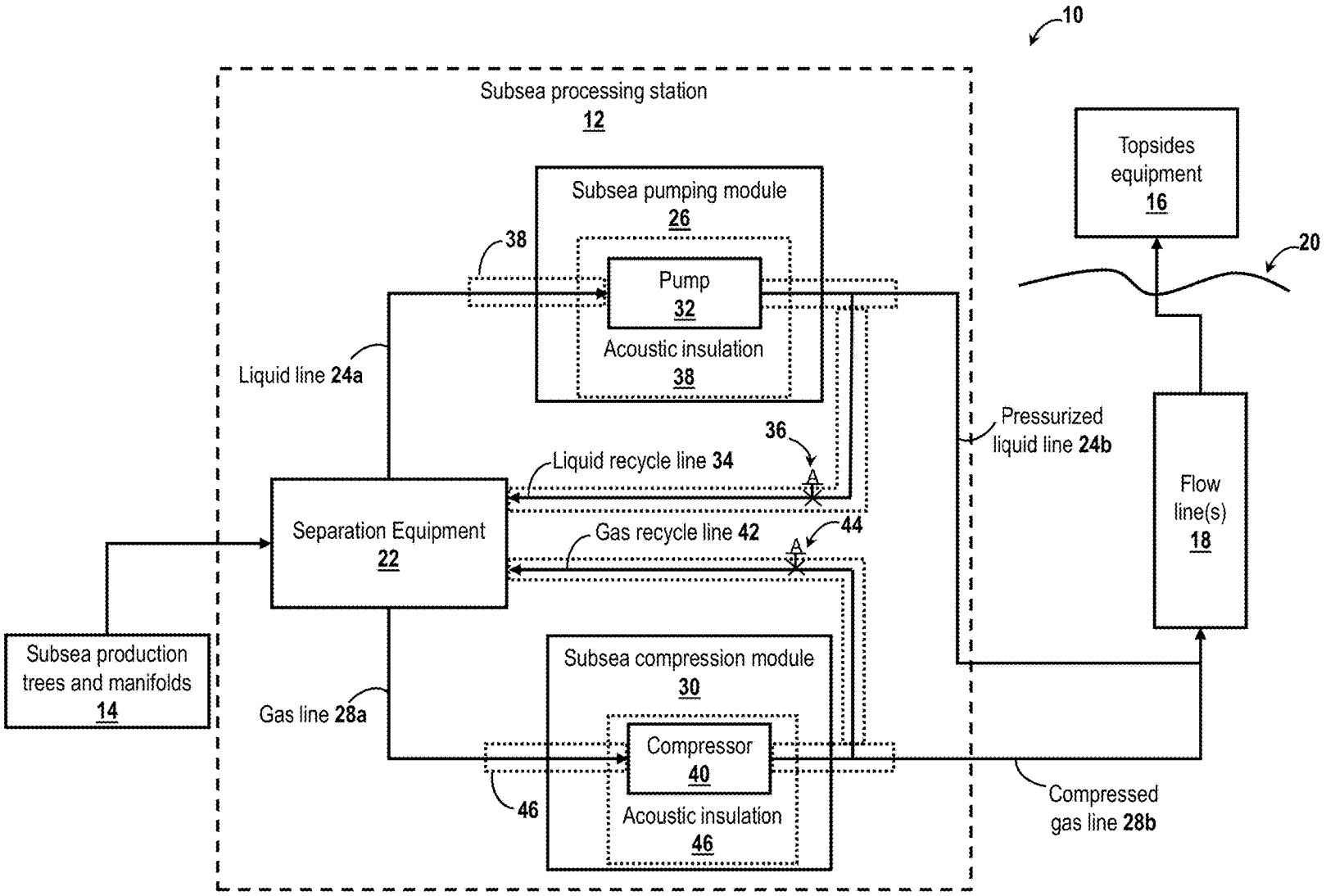
FIG. 1 is a block diagram of an example of an oil and/or gas production system utilizing subsea equipment that has subsea acoustic insulation, in accordance with an embodiment of this disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As set forth above, it is now recognized that it would be beneficial to mitigate noise generated by subsea production and processing equipment associated with oil and gas facilities. In subsea oil and gas facilities, insulation is generally done for thermal reasons to prevent onset of flow assurance issues e.g., to avoid the formation of hydrate plugs. In accordance with present embodiments, subsea acoustic insulation is applied to subsea equipment for noise mitigation in subsea oil and gas facilities. The noise mitigation/attenuation is done for targeted/applicable frequencies and in relevant shapes and sizes to reduce the acoustic profile of subsea facilities for long term deployment. As described herein, subsea acoustic insulation may include any material that is designed for use in a subsea environment, and which is configured to attenuate noise through the interruption of sound transmission via shear wave attenuation, pressure wave attenuation, or reflection, or any combination thereof.

The subsea acoustic insulation may include various segments, tiles, sheets, molds, and so forth, as described below. In certain embodiments, the subsea acoustic insulation may include anechoic tiles suitable for use in a subsea environment. Further, anechoic tiles may be considered to represent one type of acoustic insulation. The subsea acoustic insulation may be formed from a variety of materials—non-limiting examples of which include polymers such as synthetic rubber (e.g., polyisobutylene) or other synthetic elastomers including polyurethane. The subsea acoustic insulation of this disclosure may retain flexibility and noise attenuation properties at temperatures and pressures experienced at sea depths on operating process equipment at, for example, at least 100 meters, such as at least 500 meters, or at least 1000 meters, for example up to 1500 meters or 3000 meters. The subsea acoustic insulation may have a variety of sizes and shapes, and in some embodiments may include a sheet, tile or block molding of material having one or more layers having sound attenuating properties. Further, in some embodiments the subsea acoustic insulation is combined with thermal insulation in a laminated or mixed matrix arrangement. For instance, subsea equipment housing may be at least partially surrounded by a plurality of laminated insulative layers, some of which may be thermal some of which may be acoustic. Additionally or alternatively, the thermal and acoustic insulations may have a mixed matrix configuration in which the thermal and acoustic insulation are mixed within individual layers.

The noise mitigation techniques described herein may be associated with prior or concurrent installation of various subsea oil and/or gas facility equipment. Such equipment may include deep-water production trees, manifolds, structures, flow control valves, flowlines and pumping and compression equipment where the production of certain types of sound (e.g., low frequency sound, medium frequency sound, high frequency sound, or any combination) may impact subsea operation, for example due to unwanted physical consequences of the noise and/or due to regulatory requirements. A specific example is the use of the present noise mitigation techniques on certain types of rotating equipment (e.g., a compressor, a pump) associated with subsea facilities. A further example is the use of the present noise mitigation techniques applied to a subsea production tree flow control device (e.g., choke and anti-surge valves) and adjacent piping.

Generally, the subsea acoustic insulation may be configured to attenuate noise having a frequency ranging from 5 Hz to 15,000 Hz. In a first embodiment, the subsea acoustic insulation is configured to mitigate noise output from one or more subsea pumps, the noise having, by way of non-limiting example, a range of between 40 Hz and 700 Hz. In a second embodiment, the subsea acoustic insulation is configured to mitigate noise output from one or more subsea compressors in a range of between 600 Hz and 2500 Hz. In a third embodiment, the subsea acoustic insulation is configured to mitigate noise output from one or more flow control valves (e.g., choke and anti-surge valves) in a range of between 4000 Hz and 10,000 Hz. These may be used alone or in any combination, as described below.

The subsea acoustic insulation may have a design that has a complex geometry (i.e., a complex geometric shape that combines all or a portion of simple shapes). The complex geometry may be formed to correspond to a shape of a portion the pumping system, or a portion of the compression system or flow control valves, or other equipment described herein. As examples, the complex geometry may be formed to correspond to a shape associated with a compressor or pump, a shape associated with a valve, a shape associated with a conduit, and so on. The configuration of the subsea acoustic insulation may include shape, thickness, and material construction selected such that it is configured to attenuate noise having particular frequencies, such as the low frequency portion of the spectrum, the medium frequency portion of the spectrum, the high frequency portion of the spectrum, or any combination.

The embodiments of this disclosure may encompass a variety of configurations, an example of which is depicted in FIG. 1, which is a block diagram of an oil and/or gas production system 10 utilizing subsea equipment that has subsea acoustic insulation. In the illustrated embodiment, the system 10 includes a subsea processing station 12 that processes production fluids (e.g., oil, gas, or a mixture thereof) received from subsea production trees and manifolds 14. The processed production fluids generated by the subsea processing station 12 are transmitted to topsides equipment 16 by one or more flow lines 18 that cross a water line 20 (e.g., a shoreline or to a topside facility). The topsides equipment 16 may include, by way of non-limiting example, a liquefied natural gas (LNG) plant, gathering and separation facility, a petroleum-fired power plant, or the like. The system 10 may also include certain features that are not shown, such as umbilicals and a field control station (FCS) or other facility or structure above the waterline. Umbilicals may be used to transmit electrical power and/or signals, hydraulic power and/or signals, or both, between the subsea production trees and manifolds 14, the subsea processing station 12, or a combination, and the FCS or other topside facility.

In the illustrated embodiment of FIG. 1, subsea acoustic insulation is placed over a number of noise-generating features of the subsea processing station 12, such as features containing motors, rotating components, process flow restrictions as well as features that may subject certain produced fluids to changes in flow rates, increased velocities and/or pressures. The noise generated by such equipment may, therefore, be noise associated with the operation of a particular component and/or the noise associated with fluid flow through a particular component.

The subsea processing station 12 as illustrated includes separation equipment 22 that separates produced fluid into liquid and gas portions, each of which is transmitted through a respective flowline. A liquid line 24*a* transmits produced liquids to a subsea pumping module 26, while a gas line 28*a* transmits produced gases to a subsea compression module 30.

The subsea pumping module 26 includes one or more pumps 32 that motivate at least some of the produced liquid toward the topsides equipment 16 as pressurized produced liquid via a pressurized liquid line 24*b*. A liquid recycle line 34 is configured to transmit some of the pressurized produced liquid back toward the separation equipment 22 from the pressurized liquid line 24*b*, and the amount transmitted through the liquid recycle line 34 may be controlled by operation of a liquid flow control valve 36. The liquid flow control valve 36 may be positioned along the liquid recycle line 34 as illustrated or in other embodiments may be positioned at a junction between the liquid recycle line 34 and the pressurized liquid line 24*b*.

Operation of the pump 32, as well as liquid flow through any of the liquid line 24*a*, the pressurized liquid line 24*b*, the liquid recycle line 34, and the liquid flow control valve 36 may generate noise that is mitigated (e.g., attenuated) by pump acoustic insulation 38. As illustrated, the pump acoustic insulation 38 may be positioned around the pump 32, the liquid line 24*a* (e.g., only a portion of the liquid line 24*a* adjacent to the pump 32), the pressurized liquid line 24*b*, the liquid recycle line 34, and/or the liquid flow control valve 36 to mitigate noise produced by any one or a combination of these.

The subsea compression module 30 includes one or more compressors 40 that compress at least some of the produced gas and motivate it toward the topsides equipment 16 as compressed produced gas via a compressed gas line 28*b*. A gas recycle line 42 is configured to transmit some of the compressed produced gas back toward the separation equipment 22 from the compressed gas line 28*b* to protect the compressor during intermittent 'upset' conditions, and the amount transmitted through the gas recycle line 42 may be controlled by operation of a gas flow control valve 44. The gas flow control valve 44 may be positioned along the gas recycle line 42 as illustrated or in other embodiments may be positioned at a junction between the gas recycle line 42 and the compressed gas line 28*b*.

Operation of the compressor 40, as well as gas flow through any of the gas line 28*a*, the compressed gas line 28*b*, the gas recycle line 42, and the gas flow control valve 44 may generate noise that is mitigated by compressor acoustic insulation 46. As illustrated, the compressor acoustic insulation 46 may be positioned around the compressor 40, the gas line 28*a* (e.g., only a portion of the gas line 28*a* adjacent to the one or more compressors 40), the compressed gas line 28*b*, the gas recycle line 42, and/or the gas flow control valve 44 to mitigate noise produced by any one or a combination of these.

In certain embodiments, the pump acoustic insulation 38 and the compressor acoustic insulation 46 may be configured to attenuate noise having respective frequency ranges depending on the noise emission qualities of the equipment they insulate. Further, the pump acoustic insulation 38 and the compressor acoustic insulation configuration 46 may be the same or different between the different pieces of equipment depending on the noise frequencies of the piece of equipment, the geometry of the equipment, and the decibel level of the noise emitted. The pump acoustic insulation 38 and the compressor acoustic insulation 46 may include one or more insulation layers and may be an arrangement of adjoining segments consisting of molded sheets, strips or tiles attached to the equipment.

As an example, the pump acoustic insulation 38 may be a single piece of insulation surrounding the liquid line 24*a*, the pump 32, and the pressurized liquid line 24*b*, or each of these may have individual sections of the pump acoustic insulation 38. The individual sections may have the same noise attenuation profile, or different noise attenuation profiles depending on the noise level for each piece of equipment. The noise attenuation profile of the pump acoustic insulation may be tailored for a particular noise attenuation by modifying insulation layer geometry, anechoic tile geometry, material construction, molding techniques, void introduction, number of insulation layers, and so forth.

Similarly, as an example, the compressor acoustic insulation 46 may be a single piece of insulation surrounding the gas line 28*a*, the compressor 40, and the compressed gas line 28*b*, or each of these may have individual sections of the compressor acoustic insulation 46. The individual sections may have the same noise attenuation profile, or different noise attenuation profiles depending on the noise level for each piece of equipment. Again, the noise attenuation profile of the compressor acoustic insulation may be tailored for a particular noise attenuation by modifying insulation layer geometry, anechoic tile geometry, material construction, molding techniques, void introduction, number of insulation layers, and so forth.

Figure 2:
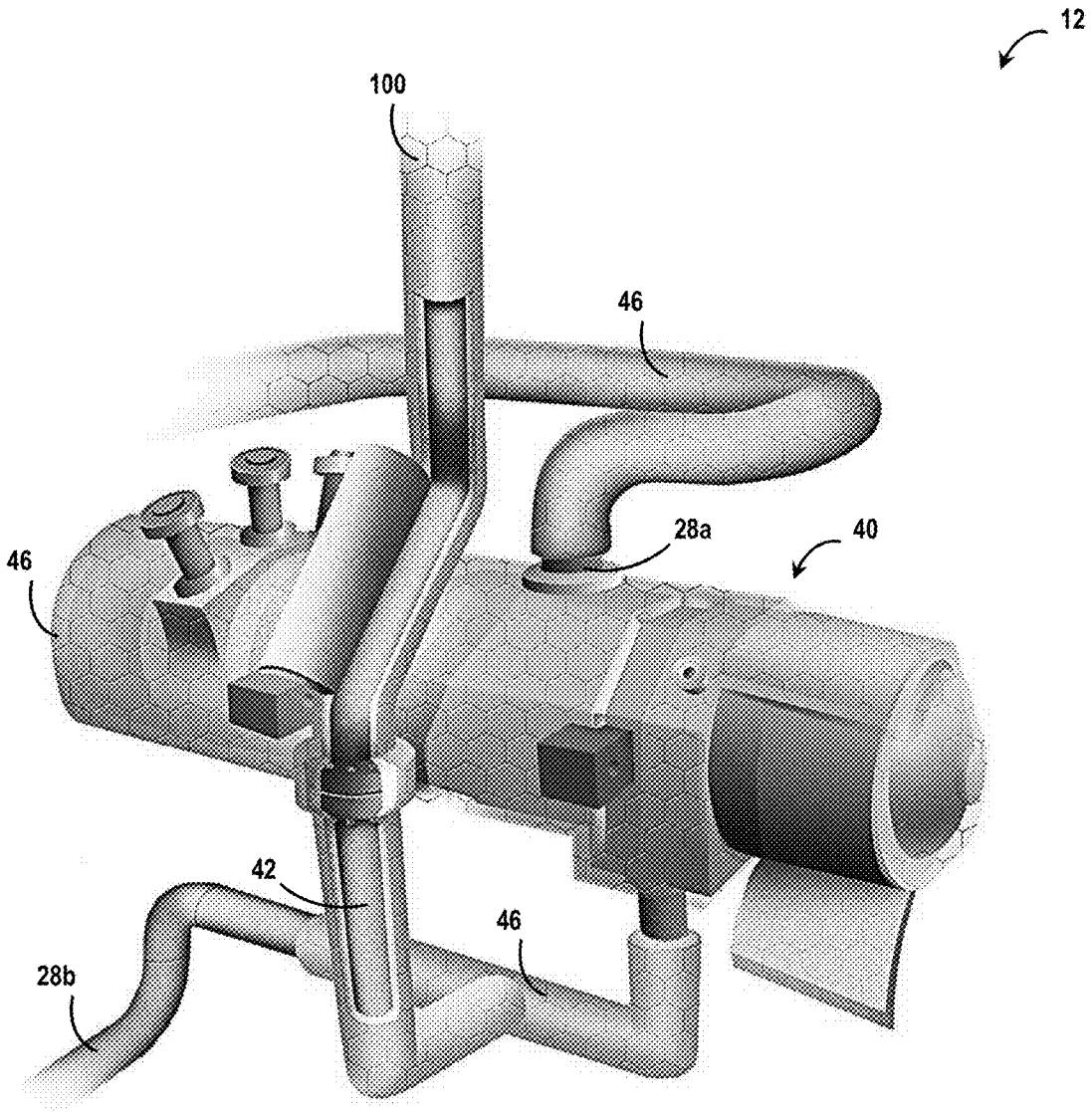
FIG. 2 is an example of the subsea compressor of FIG. 1 fitted with subsea acoustic insulation, in accordance with an embodiment of this disclosure.

FIG. 2 illustrates an example embodiment of the compressor acoustic insulation 46 applied (e.g., adhered, secured) to the compressor 40 (e.g., the body of the compressor 40), the gas line 28*a*, the compressed gas line 28*b*, and the gas recycle line 42. In the illustrated embodiment, the compressor acoustic insulation 46 is applied as molded sheets around the insulated components. The compressor acoustic insulation 46 includes a plurality of subsea acoustic insulation segments 100, which appear as discrete polygons in FIG. 2. The compressor acoustic insulation 46 may be formed entirely of the subsea acoustic insulation segments 100 as one continuous piece or may include molded strips, segments, etc., that are the subsea acoustic insulation segments 100 secured to one another using a polymer matrix, adhesive, noise retarding grout, or the like. In one embodiment, the compressor acoustic insulation 46 may be a molded (e.g., blow molded) polymeric sheet or several such segments, a clamshell, or a milled block. Further, while such a configuration is described with respect to the compressor acoustic insulation 46, the description also applies to the pump acoustic insulation 38.

In some embodiments and by way of non-limiting example, at least one of the subsea acoustic insulation segments 100 of the compressor acoustic insulation 46 (e.g., all or a majority of the insulation segments surrounding the compressor 40) may be configured to attenuate the noise generated by the compressor 40. In such embodiments, the subsea acoustic insulation segments 100 may be configured to attenuate noise having a frequency ranging from 600 Hz to 2500 Hz, though other frequency ranges may be appropriate in some circumstances. In further embodiments, the compressor acoustic insulation 46 surrounding the various lines, such as the gas line 28*a*, the compressed gas line 28*b*, and/or the recycle gas line 42 may include subsea acoustic insulation segments 100 that attenuate noise that may be in the same range or a different range than the range of the compressor noise.

Figure 3:
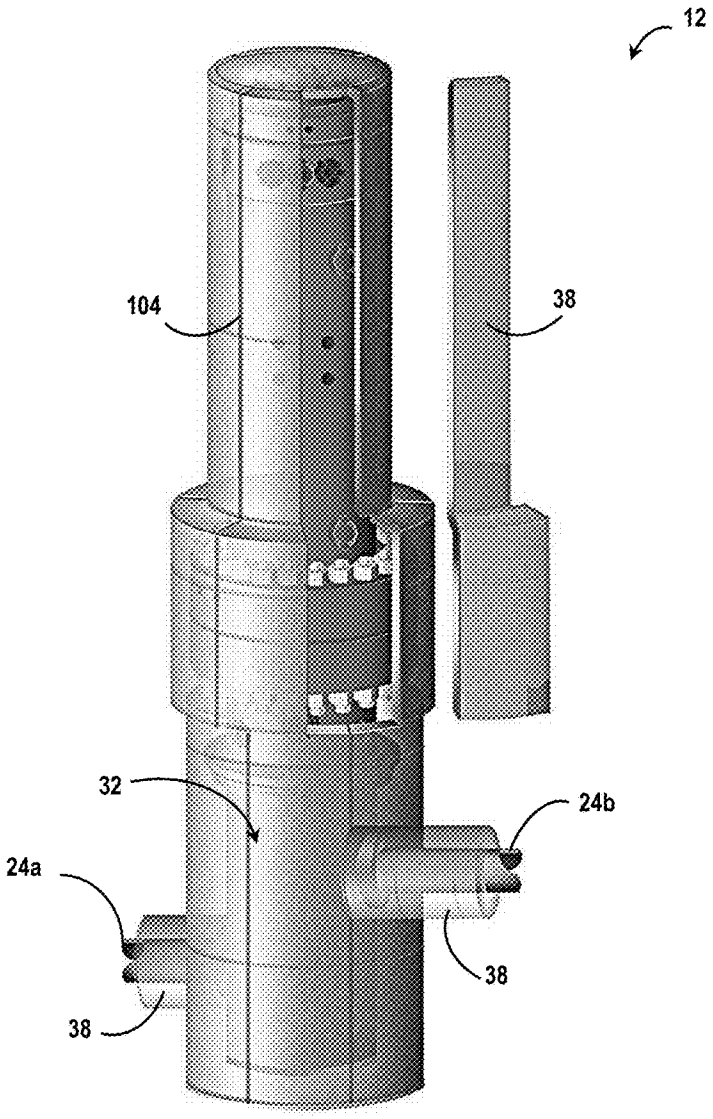
FIG. 3 is an example of the subsea pump of FIG. 1 fitted with subsea acoustic insulation, in accordance with an embodiment of this disclosure.

FIG. 3 illustrates an example embodiment of the pump acoustic insulation 38 applied (e.g., adhered, secured) to the pump 32 (e.g., the body/housing of the pump 32), the liquid line 24*a*, and the pressurized liquid line 24*b*. In the illustrated embodiment, the pump acoustic insulation 38 is applied as a wrap or clamshell around the insulated components. The pump acoustic insulation 38 includes a plurality of subsea acoustic insulation segments configured as strips 102. The strips 102 of subsea acoustic insulation may be configured to fit together at their edges to form a partial surrounding for the pump 32. In such embodiments, the strips 102 may be configured to attenuate noise having a frequency range of between 40 Hz and 700 Hz, though other frequency ranges may be appropriate in some circumstances.

A noise retarding grout or other adhesive/fill material may be placed in resulting seams 104 to fill voids therebetween to facilitate efficient noise attenuation. As shown, the pump acoustic insulation 38 may surround both a pump portion and a motor portion of the pump 32. In other embodiments, the pump acoustic insulation 38 may have a similar configuration as described above for the compressor acoustic insulation 46, except with a different noise attenuation profile.

In further embodiments, the pump acoustic insulation 38 surrounding the various lines, such as the liquid line 24*a* and/or the pressurized liquid line 24*b* may include strips 102 or other subsea acoustic insulation segments 100 (such as shown in FIG. 2) that attenuate noise that may be in the same range or a different range than the range of the pump noise.

Figure 4:
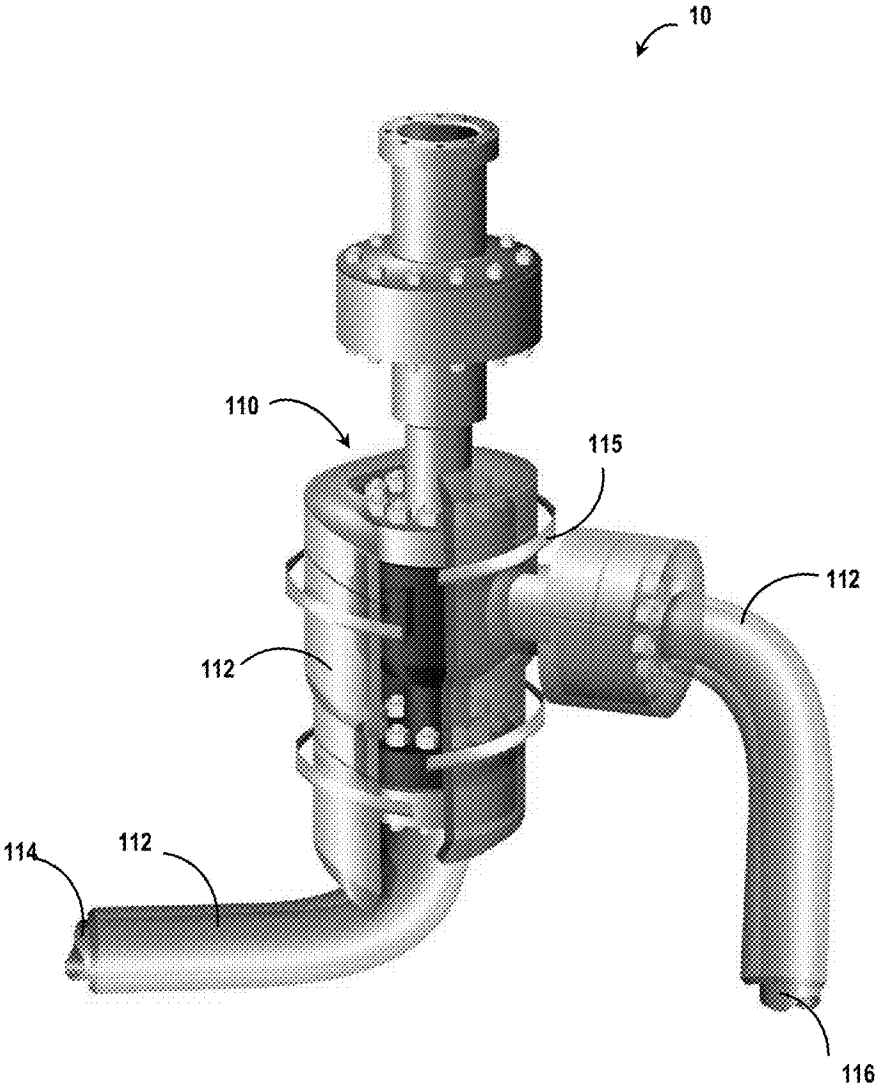
FIG. 4 is an example of a flow control valve of the system of FIG. 1 fitted with subsea acoustic insulation, in accordance with an embodiment of this disclosure.

As set forth above, subsea acoustic insulation may be placed around different noise-emitting equipment of the system 10. FIG. 4 illustrates an embodiment of a flow control valve 110—depicted as a choke valve—surrounded by subsea acoustic insulation 112 configured in accordance with this disclosure. In this embodiment and by way of non-limiting example, the subsea acoustic insulation 112 may be configured to attenuate noise in a range of between 4000 Hz and 10,000 Hz, though other frequency may be appropriate in some circumstances.

The flow control valve 110 may be considered to represent either of the gas flow control valve 36 or the liquid flow control valve 44, or another valve not shown that is part of the subsea processing station 12 or the subsea production trees and manifolds 14. For instance, the flow control valve 110 may be a choke valve that is a production choke, an anti-surge valve, or the like. Thus, the flow control valve 110 may be connected to a production fluid line, a gas line, a liquid line, and so forth.

In the illustrated embodiment, the flow control valve 110 is positioned along a first fluid flow line 114, which may be insulated using the same subsea acoustic insulation 112 positioned around the flow control valve 110 or a different subsea acoustic insulation. The subsea acoustic insulation 112 applied to the flow control valve 110 may be secured thereto by way of an adhesive and/or through the use of bindings 115 or straps tightened around a circumference of the subsea acoustic insulation 112.

The flow control valve 110 is also fluidly coupled to a second fluid flow line 116 that is insulated using the same subsea acoustic insulation 112 positioned around the flow control valve 110 or a different subsea acoustic insulation. Whether the subsea acoustic insulation 112 used in the depicted embodiment is the same or different between the flow control valve 110 and the first and second fluid flow lines 114, 116 may depend on whether they emit noise at sufficiently different frequencies to warrant the use of different subsea acoustic insulation. However, in certain embodiments, the subsea acoustic insulation 112 may be configured to have a broad enough noise attenuation frequency range to be useful for the equipment illustrated in FIG. 4.

In accordance with this disclosure, it should be appreciated that the subsea acoustic insulation techniques described herein may be applied to a number of different subsea oil and gas components. In an example embodiment, a method of mitigating noise associated with a subsea oil and gas facility may include identifying noise emitted by components of the subsea oil and gas facility, such as the system 10 of FIG. 1. This identification may include identifying the frequencies and levels of the emitted noise. The method may further include applying subsea acoustic insulation that has noise attenuating properties sufficient to attenuate the emitted noise by a particular amount. Thus, the applied subsea acoustic insulation may attenuate the emitted noise such that the emitted noise does not result in undesirable physical processes and/or complies with a predetermined noise requirement (e.g., the maintenance of noise to under a certain threshold). Thus, the subsea acoustic insulation may mitigate noise associated with, for example, any one or a combination of a deep-water production tree, flow control devices, a deep-water manifold or structure, subsea pumping equipment, or subsea compression equipment.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems described in this disclosure.

It will be understood that various modifications may be made to the embodiments disclosed herein. Therefore, the above description should not be construed as limiting, but merely as exemplifications of example embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

The invention claimed is:

1. A subsea oil and/or gas production system comprising:

subsea equipment configured to produce, process, and transmit fluids from a subsea well to topsides equipment configured to receive processed produced fluids from the subsea equipment; and subsea acoustic insulation surrounding at least a portion of the subsea equipment that generates noise during operation, the subsea acoustic insulation being configured to attenuate noise emitted by the portion of the subsea equipment, wherein the subsea acoustic insulation comprises an arrangement of adjoining segments including single continuously molded sheets, strips or tiles positioned around the subsea equipment.

2. The system of claim 1, wherein the subsea equipment comprises a subsea processing station having the portion of the subsea equipment that generates noise during operation.

3. The system of claim 2, wherein the portion of the subsea equipment comprises a subsea pump, and wherein the acoustic insulation is applied at least partially around the subsea pump.

4. The system of claim 2, wherein the portion of the subsea equipment comprises a subsea compressor, and wherein the acoustic insulation is applied at least partially around the subsea compressor.

5. The system of claim 2, wherein the subsea processing station comprises a pumping module and a compression module, and wherein the portion of the subsea equipment that generates noise during operation and to which the subsea acoustic insulation is applied is a part of the pumping module or the compression module, or both.

6. The system of claim 1, wherein the subsea equipment comprises one or more subsea production trees and manifolds and structures, and wherein the portion of the subsea equipment that generates noise during operation and to which the subsea acoustic insulation is applied is a part of the one or more subsea production trees and manifolds and structures.

7. The system of claim 1, wherein the subsea acoustic insulation has a complex geometry that corresponds to a shape of the portion of the subsea equipment.

8. The system of claim 1, wherein the subsea acoustic insulation is configured to mitigate noise output from a subsea compressor, the noise having a range of between 600 Hz and 2500 Hz.

9. The system of claim 1, wherein the subsea acoustic insulation is configured to mitigate noise output from a subsea pump, the noise having a range of between 40 Hz and 700 Hz.

10. The system of claim 1, wherein the subsea acoustic insulation comprises one or more insulation layers.

11. The system of claim 1, wherein the subsea acoustic insulation is combined with thermal insulation in a laminated or mixed matrix arrangement.

12. The system of claim 1, wherein the portion of the subsea equipment comprises one or more flow control valves, or a combination thereof, and the subsea acoustic insulation is configured to mitigate noise output from the one or more flow control valves and associated piping.

13. The system of claim 12, wherein the subsea acoustic insulation is configured to attenuate noise in a range of between 4000 Hz and 10,000 Hz.

14. The system of claim 1, wherein the subsea acoustic insulation comprises laminated layers of either acoustic insulation only or combined acoustic and thermal insulation.

15. The system of claim 1, wherein the subsea acoustic insulation is attached to the portion of the subsea equipment via adhesives between material and equipment housing and/or external banding and strapping.

16. The system of claim 1, comprising noise retardant grouting applied in voids between the adjoining segments for continuity of coverage.

17. A subsea compression module configured for use in a subsea environment, comprising a subsea compressor configured to compress a fluid produced from a subsea oil and/or gas well and having subsea acoustic insulation configured to attenuate noise generated by the subsea compressor during operation, wherein the subsea acoustic insulation surrounds at least a portion of an exterior of the subsea compressor, and wherein the subsea acoustic insulation comprises an arrangement of adjoining segments including single continuously molded sheets, strips or tiles positioned around the subsea compressor.

18. A subsea pumping module configured for use in a subsea environment, comprising a subsea pump configured to pressurize a fluid produced from a subsea oil and/or gas well and having subsea acoustic insulation configured to attenuate noise generated by the subsea pump during operation, wherein the subsea acoustic insulation surrounds at least a portion of an exterior of the subsea pump, and wherein the subsea acoustic insulation comprises an arrangement of adjoining segments including single continuously molded sheets, strips or tiles positioned around the subsea pump.

19. A deepwater production tree configured for use in a subsea environment, comprising a flow control valve configured to modulate fluid produced from a subsea oil and/or gas well and having subsea acoustic insulation configured to attenuate noise generated by the flow control valve during production, wherein the subsea acoustic insulation surrounds at least a portion of an exterior of the flow control valve, and wherein the subsea acoustic insulation comprises an arrangement of adjoining segments including single continuously molded sheets, strips or tiles positioned around the flow control valve.

20. A method of mitigating noise associated with a subsea oil and gas facility, comprising using subsea acoustic insulation to mitigate noise associated with subsea equipment, the subsea equipment including any one or a combination of a deep-water production tree, flow control valves and piping, a deep-water manifold or structure, subsea pumping equipment, or subsea compression equipment, wherein the subsea acoustic insulation comprises an arrangement of adjoining segments including single continuously molded sheets, strips or tiles positioned around the subsea equipment.

* * * * *